US008344232B2

(12) United States Patent
Booth

(10) Patent No.: US 8,344,232 B2
(45) Date of Patent: Jan. 1, 2013

(54) MULTIPLE STRING TUNING PEG ASSEMBLY

(76) Inventor: Isaiah-John Makana Booth, Portland, OR (US)

( * ) Notice: Subject to any disclaimer, the term of this patent is extended or adjusted under 35 U.S.C. 154(b) by 103 days.

(21) Appl. No.: 13/039,250

(22) Filed: Mar. 2, 2011

(65) Prior Publication Data

US 2012/0222538 A1 Sep. 6, 2012

(51) Int. Cl.
*G10D 3/00* (2006.01)

(52) U.S. Cl. ..... 84/304

(58) Field of Classification Search ..... 84/312 R, 84/304–306

See application file for complete search history.

(56) References Cited

U.S. PATENT DOCUMENTS 494,025 A * 3/1893 Pettersson ..... 84/274

* cited by examiner

*Primary Examiner* — Kimberly Lockett
(74) *Attorney, Agent, or Firm* — Mark S. Hubert

(57) ABSTRACT

A multiple string tuning peg for a stringed musical instrument capable of independently tuning at least two strings. It minimizes the amount of clutter at the top end of a stringed instrument and maximizes the use of the mechanical gearing assemblies by sharing mechanical components. A single thumb twist can be physically manipulated to operated the multiple string winding mechanisms.

17 Claims, 5 Drawing Sheets

FIG. 8
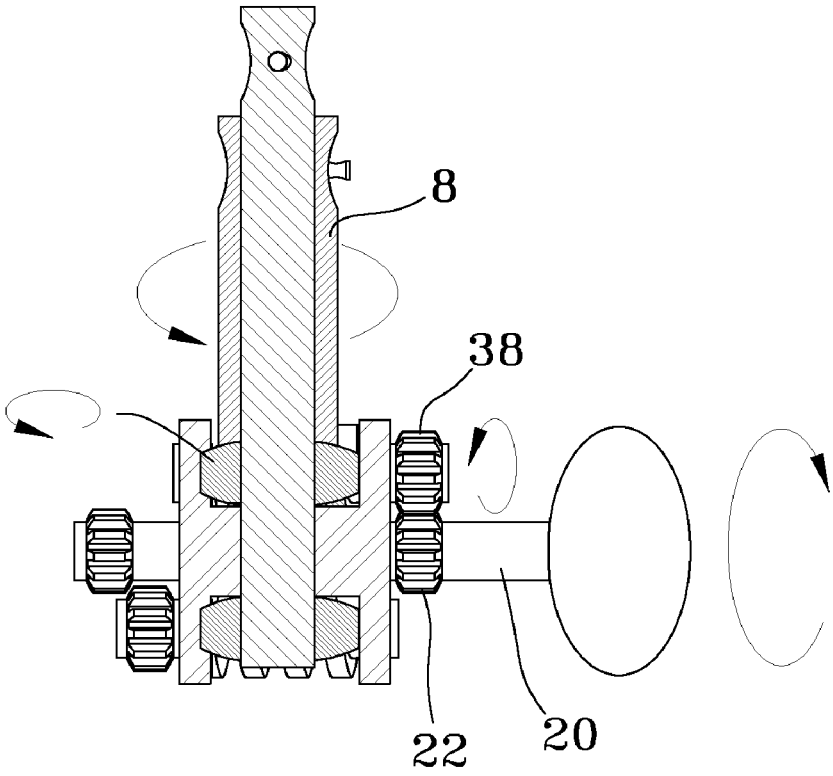
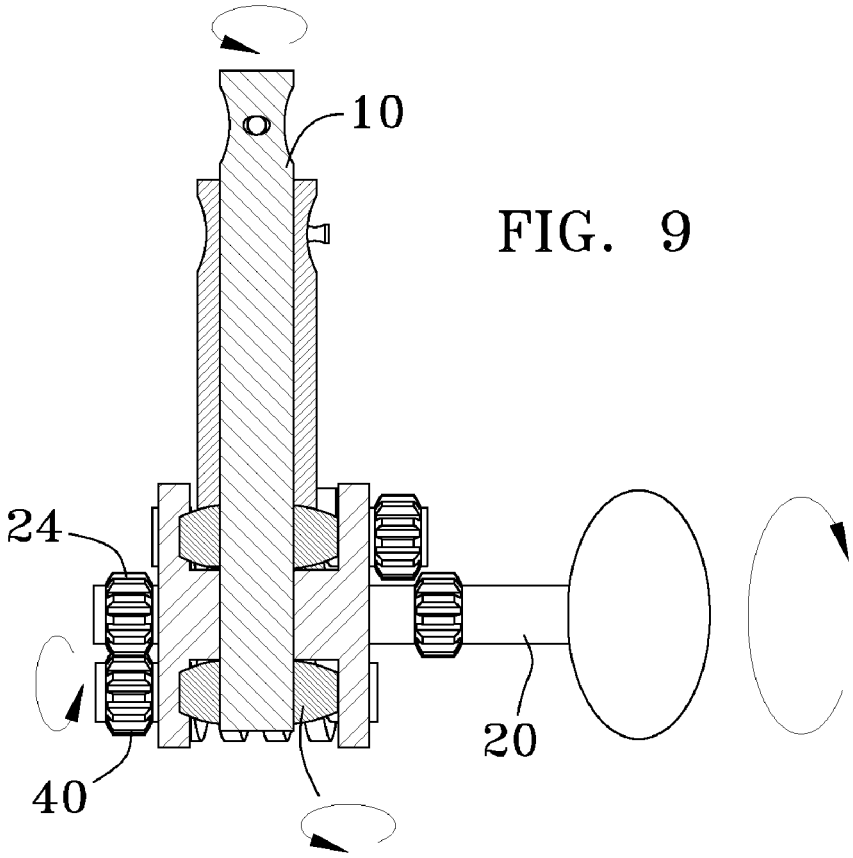
FIG. 9

MULTIPLE STRING TUNING PEG ASSEMBLY

BACKGROUND OF THE INVENTION

The present invention relates to a extremely new tuning peg assembly for a stringed instrument adapted to provide the luthier or stringed instrument craftsman the tools needed to design a completely new design for the top end of the instrument.

Guitars, mandolins, banjos, ukeleles, etc have utilized single tuning pegs since their inception. This has drawbacks in that it requires one tuning peg assembly to be incorporated onto the top end of each stringed instrument for each string that the instrument has. This has forced each of the stringed instruments to look essentially the same. Even the non musically inclined will agree that each 12 string guitar (aside from color) looks strikingly similar to all other 12 string guitars. The upper and lower bouts, bridges, neck and frets have very limited ranges of physical placement and configurations. Heretofore, the placement and design of single string tuning peg assemblies have also been extremely limited. As such the luthier has limited range of physical configurations that they can incorporate into their instrument design.

Henceforth, a multiple string tuning peg assembly would fulfill a long felt need in the stringed instrument industry. With proper marketing these new designs could be the "in look" for modern stringed instruments, uncluttering the instrument's top end and changing the look. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a stringed instrument tuning peg design that will not change the quality of music from the instrument yet will allow a plethora of new designs to stringed instruments. It has many of the advantages mentioned heretofore and many novel features that result in a new stringed instrument tanning peg which is not anticipated, rendered obvious, suggested, or even implied by any of the prior art, either alone or in any combination thereof.

In accordance with the invention, an object of the present invention is to provide an improved multiple string tuning peg capable of allowing individual string tuning with a minimum of mechanical parts.

It is another object of this invention to provide an improved string tuning peg system that minimizes the amount of space required to install on a stringed instrument.

It is a further object of this invention to provide a tuning system for stringed instruments that will allow instrument makers to employ visually new design in guitars and other stringed instruments.

It is still a further object of this invention to provide for a system that allows for the tuning of multiple strings utilizing many of the same mechanical components and eliminating others through common usage of components.

It is yet a further object of this invention to provide a compact system for tuning stringed instruments that operates in a fashion common to musicians.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 8 is a front cross sectional view of the multiple string tuning peg engaged for the operation of the outer peg;

FIG. 9 is a front cross sectional view of the multiple string tuning peg engaged for the operation of the inner peg;

DETAILED DESCRIPTION

Figure 1:
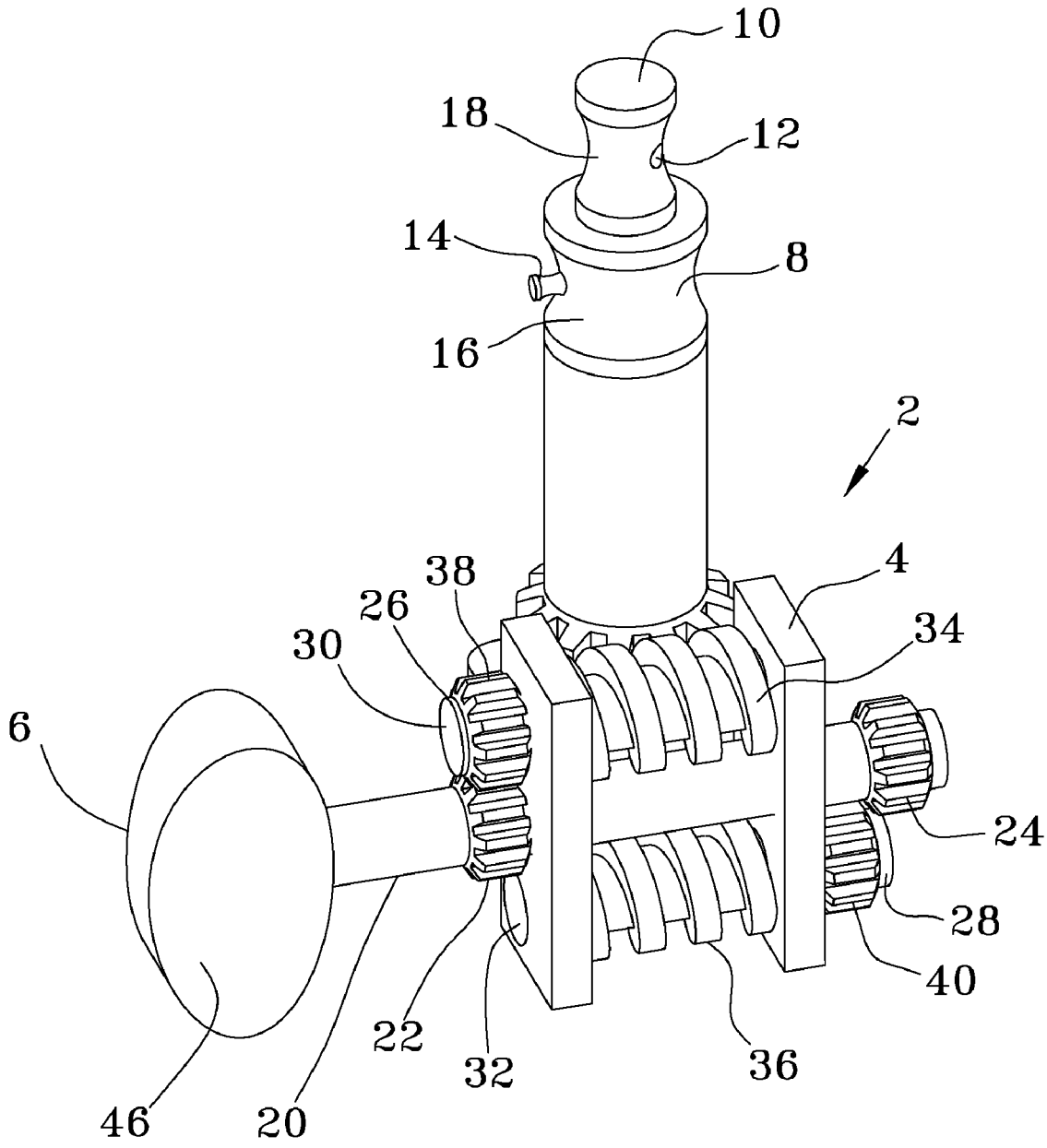
FIG. 1 is a front perspective view of the multiple string tuning peg showing the general arrangement of all components.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Looking at FIG. 1 it can be seen that the multi string tuning device 2 is made up of the following six interconnected components: the support frame 4, a tuning peg key 6, first and second tuning pegs 8/10 and first and second winding assemblies 26/28.

Figure 10:
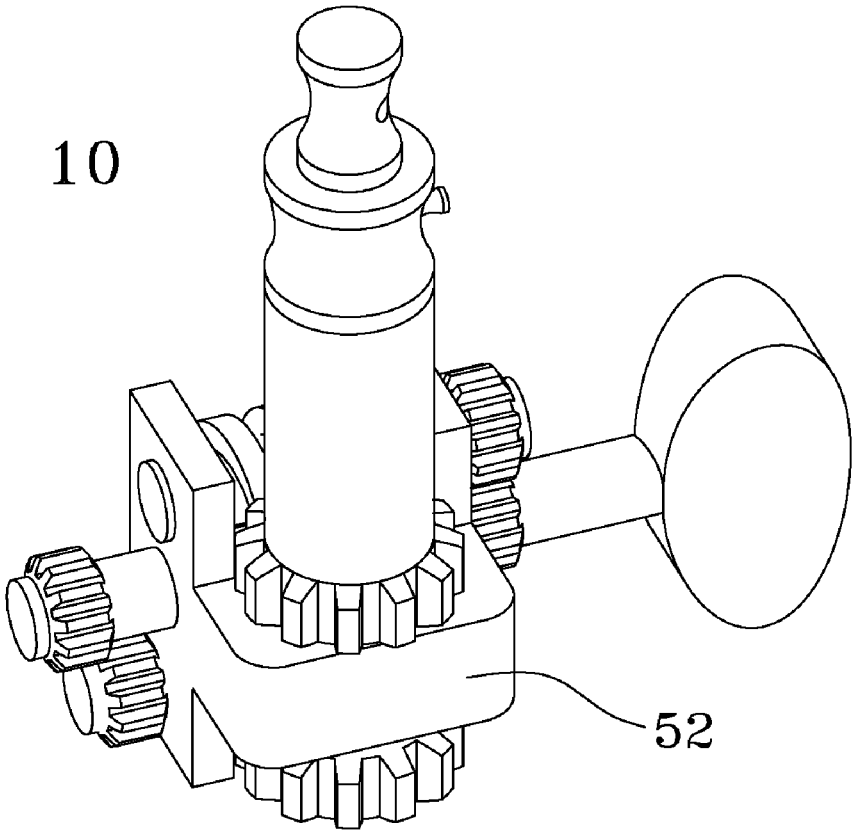
FIG. 10 is a back perspective view of the multiple string tuning peg.
Figure 11:
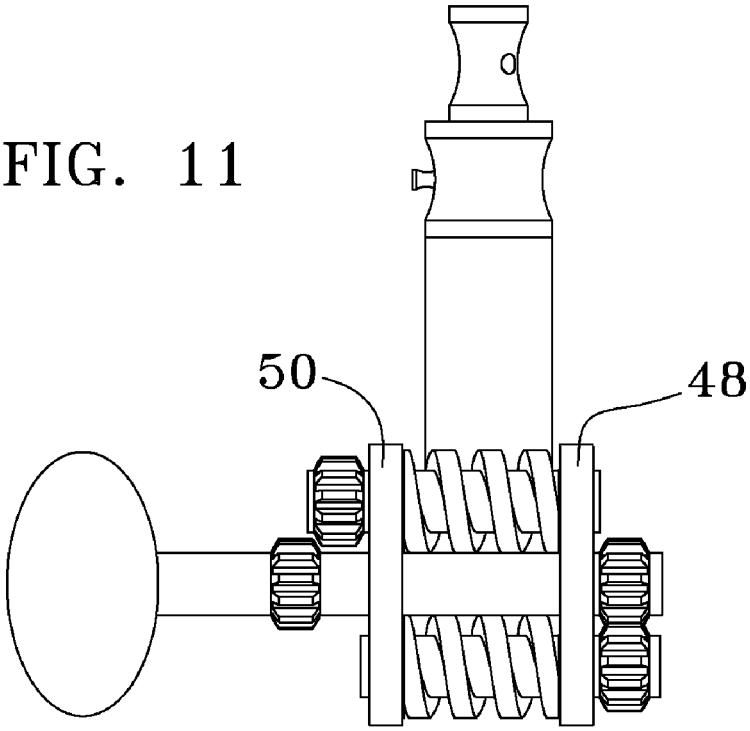
FIG. 11 is a rear side view of the multiple string tuning peg engaged for operation of the inner peg.

Looking at FIGS. 1, 10 and 11 it can be seen that support frame 4 has two parallel side plates 48 and 50 held in their parallel positions by a perpendicular central plate 52. The central plate 52 has a first orifice formed therethrough that rotatably houses the second tuning peg 10. Second tuning peg 10 is the inner peg of the key two tuning peg assembly. Each side plate has upper, intermediate and lower orifices formed therethrough. The upper orifices rotatably house the first winding assembly 26. The lower orifices rotatably house the second winding assembly. The intermediate orifices rotatably and slidably house the tuning peg key 6. The support frame 4 is designed to both house all of the components of the multi string tuning device 2 and serve as the attachment means to the musical instrument. There is a plethora of plates, threaded recesses and adapting fixtures that may be mechanically affixed to said support frame 4 depending upon the musical instrument that it is to be used with. The mounting for a piano would be different from the mounting on a harp, guitar or banjo. The specific means of mounting a multi stringed tuning device 2 would be well known in the field of constructing musical instruments and is not addressed herein.

First tuning peg 8 resides about the second tuning peg 10 such that they are nestled together and share a common axis of rotation. The first tuning peg 8 is shorter along its linear axis than the second tuning peg 10 such that the second tuning peg 10 extends beyond the distal and proximate ends of the first tuning peg 8. The second tuning peg has a second worm wheel gear 44 attached at its proximate end that resides below a lower face of said central plate 52. The first tuning peg has a first worm wheel gear 42 attached at its proximate end that resides above an upper face of said central plate 52. (See FIG. 4.) Although not illustrated, a friction reducing surface treatment may be utilized on the interface surfaces between the first tuning peg 8 and the second tuning peg 10. This may be a liquid or solid treatment or optionally one or both of these pegs may be made of a low friction material.

Looking at FIGS. 8 and 9 it can be seen that the first tuning peg 8 has a first grooved string winding region 16 formed thereon and a string retention post 14 that extends therefrom to ensnare the musical instrument's first string for tuning. The second tuning peg 10 has a second grooved string winding region 18 that has a string retention orifice formed therethrough to ensnare the musical instrument's second string for tuning. It is to be noted that the second tuning peg 10 is rotatable housed within an accommodatingly sized orifice formed in the central plate 52 and it cannot come free from the support frame 4 because of the physical interference between the second worm wheel gear 44 and the hole in the central plate. The first tuning peg 8 is kept in its position about the second tuning peg 10 because of the physical interference between the second tuning peg 10 and the first worm wheel gear 44.

Figure 2:
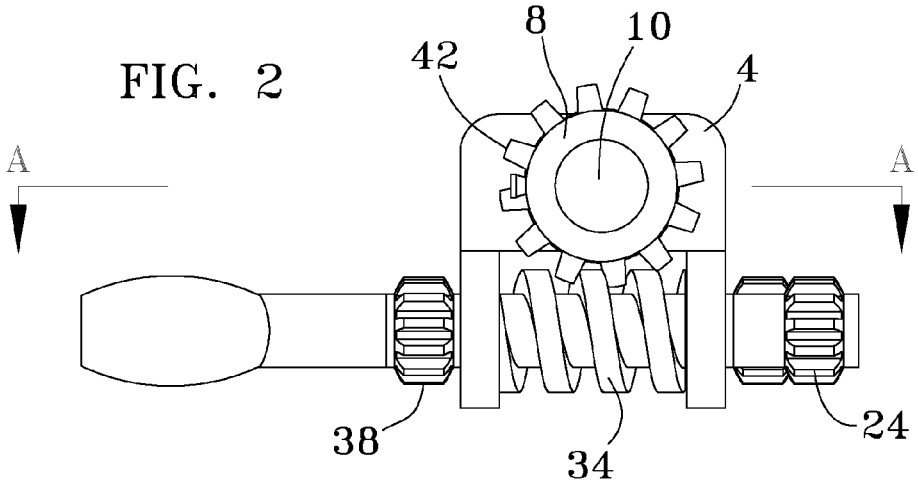
FIG. 2 is a top view of the multiple string tuning peg.
Figure 5:
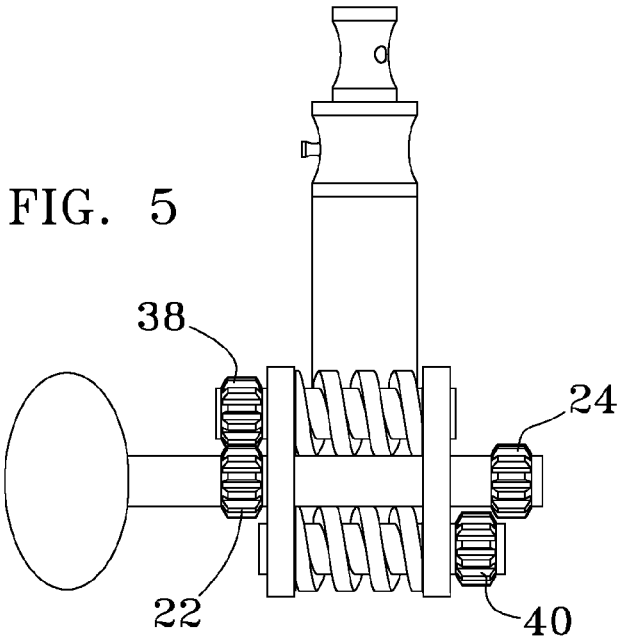
FIG. 5 is a front side view of the multiple string tuning peg engaged for operation of the outer peg.

Looking at FIGS. 2 and 5 it can be seen that the first winding assembly 26 is a first cylindrical shaft 30 with a first worm gear 34 rigidly affixed about its central region and a first spur gear 38 rigidly affixed about its distal end.

Figure 3:
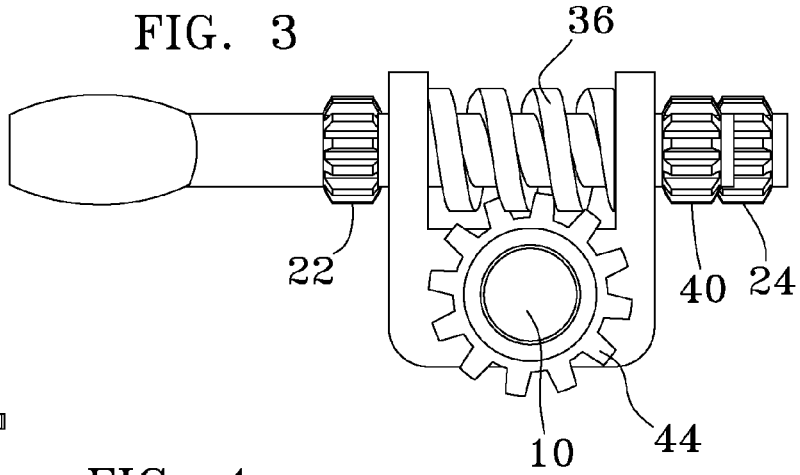
FIG. 3 is a bottom view of the multiple string tuning peg.
Figure 6:
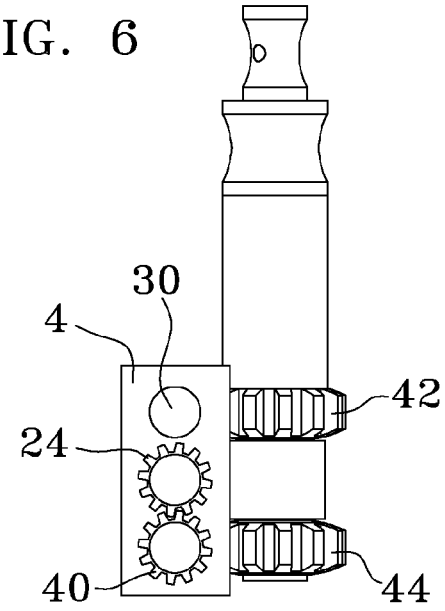
FIG. 6 is a right side view of the multiple string tuning peg.
Figure 7:
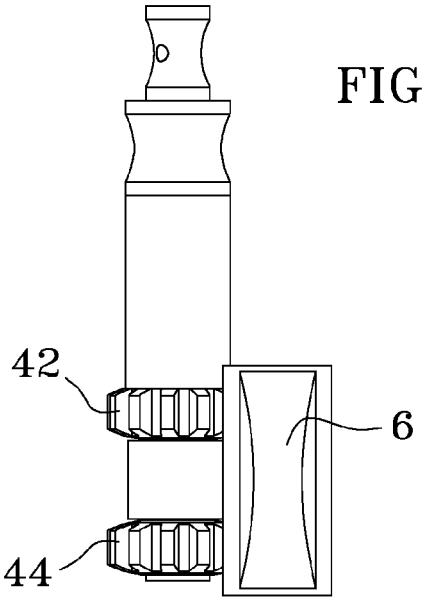
FIG. 7 is a left side view of the multiple string tuning peg.

Looking at FIGS. 3 and 5 it can be seen that second winding assembly 28 is a second cylindrical shaft 32 with a second worm gear 36 rigidly affixed about its central region and a second spur gear rigidly affixed about its distal end. These first and second winding assemblies are substantially identical however they are mounted in their respective upper and lower orifices such that their spur gears reside adjacent different side plates of the support frame 4. (See FIGS. 6 and 7.)

It is to be noted that while depicted as straight cut gears, the spur gears 38/40, and pinion gears 22/24 may be of a different physical design.

The winding assemblies' respective worm gears 42/44 meshingly engage the worm wheel gears 34/36 on the first and second tuning pegs 8/10 so as to translate rotational motion of the winding assemblies in one axis to rotational motion of the tuning pegs 8/10 in a second, perpendicular axis. Essentially, they change horizontal rotational motion into vertical rotational motion or vice versa.

Figure 4:
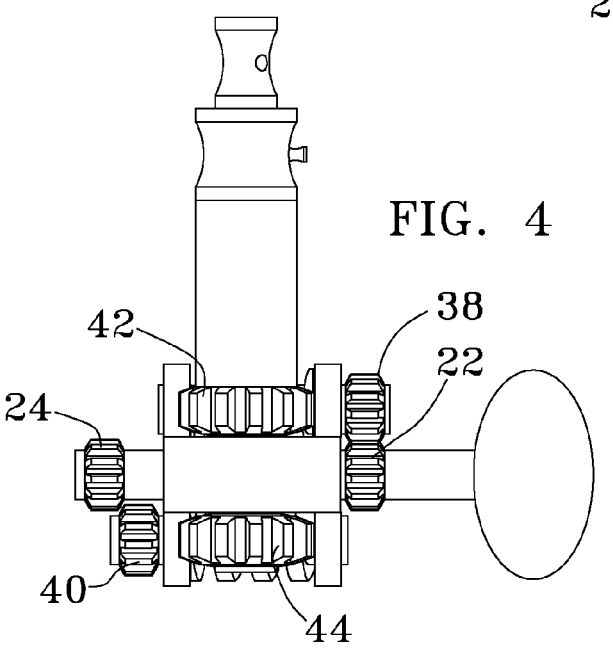
FIG. 4 is a rear side view of the multiple string tuning peg.

Looking at FIGS. 4 and 5 the physical design of the tuning peg key 6 can best be seen. The tuning peg key 6 is made of a third cylindrical shaft 20 with a thumb twist 46 rigidly affixed to its proximate end and a outboard pinion gear 24 rigidly affixed to its distal end. There is an inboard pinion gear 22 rigidly affixed to the third cylindrical shaft 20 between a side plate of the support frame 4 and the thumb twist 46. The third cylindrical shaft is longer than both the first and second cylindrical shafts of the winding assemblies. The tuning peg key 6 is both rotatably and slidingly housed in the intermediate orifice of the support frame 4. It is to be noted that the axes of rotation of the tuning peg key 6 and the first winding assembly 26 and the second winding assembly 28 all lie in a common plane. It is the sliding ability of the tuning peg key 6 that allows its outboard pinion gear 24 to independently engage and operate (drive) the second spur gear 40 or allows its inboard pinion gear 22 to independently engage and operate (drive) the first spur gear 38. Note, that there can only be one spur gear 38/40 rotatably enmeshed with one of the pinion gears 22/24 at any time.

The operation of the multi stringed tuning device 2 can best be seen with reference to FIGS. 8 and 9. In FIG. 8 the tuning peg key 6 is horizontally slid such that its inboard pinion gear 22 engages first spur gear 38 on the first winding assembly 26. Twisting the thumb twist 46 on the tuning peg key 6 in a clockwise direction as indicated rotates the inboard pinion gear 22 clockwise, the first spur gear 38 and first worm gear 34 of the first winding assembly 26 counterclockwise, and the first worm wheel gear 44 of the first tuning peg 8 counterclockwise. Since the first worm wheel gear 44 is rigidly attached about the tuning peg, with a first string wrapped around post 14 the first string will wrap around the first tuning peg 8 in the first winding groove 16 and tighten the first string, Loosening the first string will require the counterclockwise rotation of the tuning peg key 6. The tension exerted by the first string back on the first tuning peg 8 is insufficient to overcome the torque needed to rotate the first worm gear 34 through the first worm wheel gear 44.

In FIG. 9 the tuning peg key 6 is horizontally slid such that its inboard pinion gear 22 no longer engages spur gear 38 on the first winding assembly 26. But rather such that its outboard pinion gear 24 engages second spur gear 40 on the second winding assembly 28. Twisting the thumb twist 46 on the tuning peg key 6 in a clockwise direction as indicated rotates the outboard pinion gear 24 clockwise, the second spur gear 40 and second worm gear 36 of the second winding assembly 28 counterclockwise, and the second worm wheel gear 46 of the second tuning peg 10 counterclockwise. Since the second worm wheel gear 46 is rigidly attached about the second tuning peg, with a second string inserted through orifice 12 the second string will wrap around the second tuning peg 10 in the second winding groove 18 and tighten the second string, Loosening a string will require the counterclockwise rotation of the tuning peg key 6. Similarly, the tension exerted by the second string back on the second tuning peg 10 is insufficient to overcome the torque needed to rotate the second worm gear 36 through the second worm wheel gear 46.

Although depicted with worm gears as the primary tensioning mechanism it is well known in the art that there are other gearing arrangements that could also be modified to cooperate in a fashion similar that illustrated herein.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. An integrated multi string tuning device for independently tuning stringed musical instruments comprising:

one support frame;

at least two worm geared winding assemblies rotatably housed within said support frame;

at least two string tuning pegs rotatably housed within said support frame; and one multi position tuning key;

wherein said tuning key is rotatably and slidingly housed in said support frame between and in rotatable mechanical engagement with one of said geared winding assemblies which are each in rotatable mechanical engagement with one of said string tuning pegs.

2. The multi stringed tuning device of claim 1 further comprising:

a first string tuning peg; and a second string tuning peg;

wherein said second string tuning peg is rotatably housed within said first string tuning peg.

3. The multi stringed tuning device of claim 2 wherein a longitudinal axis of said first string tuning peg and a longitudinal axis of said second string tuning peg are a common axis about which each of said tanning pegs can independently rotate.

4. The multi stringed tuning device of claim 3 wherein said first tuning peg has a first string winding groove formed thereon at a distal end thereof, and wherein said second tuning peg has a second string winding groove formed thereon at a distal end thereof.

5. The multi stringed tuning device of claim 4 wherein said first tuning peg has a string retention orifice formed therethrough said first string groove and wherein said second tuning peg has a string retention post formed thereon said second string groove to accommodate the retention of a musical instrument first string or a musical instrument second string.

6. The multi stringed tuning device of claim 3 wherein said first tuning peg has a first worm wheel gear affixed about said first tuning peg at a proximate end thereof, and said second tuning peg has a second worm wheel gear affixed about said second tuning peg at a proximate end thereof.

7. The multi stringed tuning device of claim 3 further comprising:

a first geared winding assembly; and a second geared winding assembly;

wherein said first geared winding assembly and said second geared winding assembly are substantially identical, and wherein said first geared winding assembly is a first circular shaft with a first worm gear formed about a central region thereof and a first spur gear affixed to an end thereof that extends outside of said housing, and said second geared winding assembly is a second circular shaft with a second worm gear formed about a central region thereof and a second spur gear affixed to an end thereof that extends outside of said housing.

8. The multi string tuning device of claim 7 wherein said first worm gear is enmeshed with a first worm wheel gear affixed to said first tuning peg for the translation of rotational motion of said first geared winding assembly about a first axis to rotational motion of said first tuning peg in a second, perpendicular axis, and said second worm gear is enmeshed with a second worm wheel gear affixed to said second tuning peg for the translation of rotational motion of said second geared winding assembly about a third axis to rotational motion of said second tuning peg about said second, perpendicular axis.

9. The multi stringed tuning device of claim 6 further comprising:

a first geared winding assembly; and a second geared winding assembly;

wherein said first geared winding assembly and said second geared winding assembly are substantially identical, and wherein said first geared winding assembly is a first circular shaft with a first worm gear formed about a central region thereof and a first spur gear affixed to an end thereof that extends outside of said housing, and said second geared winding assembly is a second circular shaft with a second worm gear formed about a central region thereof and a second spur gear affixed to an end thereof that extends outside of said housing.

10. The multi string tuning device of claim 9 wherein said first worm gear is enmeshed with said first worm wheel gear for the translation of rotational motion of said first geared winding assembly about a first axis to rotational motion of said first tuning peg in a second, perpendicular axis, and said second worm gear is enmeshed with said second worm wheel gear for the translation of rotational motion of said second geared winding assembly about a third axis to rotational motion of said second tuning peg about said second, perpendicular axis.

11. The multi string tuning device of claim 10 wherein said multi position winding key is a third cylindrical shaft with a thumb twist knob affixed at a proximate end thereof and an inboard pinion gear affixed adjacent said thumb twist knob and an outboard pinion gear affixed at a distal end of said shaft.

12. The multi string tuning device of claim 11 wherein said shaft is slidingly moveable within said support frame to engage said inboard pinion gear with said first spur gear or to engage said outboard pinion gear with said second spur gear.

13. The multi string tuning device of claim 12 wherein said inboard pinion gear enmeshes with said first spur gear to translate rotational motion of said winding key about a fourth axis to said rotational motion of said first geared winding assembly about said first axis, and wherein when said outboard pinion gear enmeshes with said second spur gear it translates rotational motion of said winding key about said fourth axis to said rotational motion of said second geared winding assembly about said third axis wherein said first axis, said third axis and said fourth axis are parallel axes.

14. The multi string tuning device of claim 13 wherein said support frame has two substantially identical parallel side plates connected by a central perpendicular plate.

15. The multi string tuning device of claim 14 wherein said parallel side plates have an upper, intermediate and lower orifice formed therethrough and wherein said first circular shaft of said first geared winding assembly rotatably extends through said upper orifices, said second circular shaft of said second geared winding assembly rotatably extends through said lower orifices and said third shaft of said winding key rotatably extends through said intermediate orifices.

16. The multi stringed tuning device of claim 3 wherein at least one surface of a physical interface between said first tuning peg and said second tuning peg has a friction reducing surface treatment thereon.

17. The multi stringed tuning device of claim 16 wherein at least one surface of a physical interface between said first tuning peg and said second tuning peg has a friction reducing surface treatment thereon.

* * * * *